US011417459B2

(12) United States Patent
Naruse

(10) Patent No.: US 11,417,459 B2
(45) Date of Patent: Aug. 16, 2022

(54) IGNITION SYSTEM

(71) Applicant: Mitsubishi Electric Corporation, Tokyo (JP)

(72) Inventor: Yusuke Naruse, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 17/298,273

(22) PCT Filed: Dec. 14, 2018

(86) PCT No.: PCT/JP2018/046091
§ 371 (c)(1),
(2) Date: May 28, 2021

(87) PCT Pub. No.: WO2020/121515
PCT Pub. Date: Jun. 18, 2020

(65) Prior Publication Data

US 2022/0028605 A1 Jan. 27, 2022

(51) Int. Cl.
*H01F 38/12* (2006.01)
*F02P 3/02* (2006.01)

(52) U.S. Cl.
CPC ..... *H01F 38/12* (2013.01); *F02P 3/02* (2013.01)

(58) Field of Classification Search
CPC ..... H01F 38/12; H01F 2038/122; H01F 2038/127; F02P 3/02; F02P 3/04
See application file for complete search history.

(56) References Cited

U.S. PATENT DOCUMENTS 9,399,979 B2 7/2016 Heise et al.
2016/0047349 A1* 2/2016 Ayusawa ..... F02P 5/1551 123/406.23
2018/0195485 A1* 7/2018 Seimiya ..... F02P 15/10
2020/0318598 A1* 10/2020 Iwaki ..... F02P 3/05

FOREIGN PATENT DOCUMENTS

WO 2016/157541 A1 10/2016
WO 2017/183062 A1 10/2017

OTHER PUBLICATIONS

International Search Report for PCT/JP2018/046091, dated Mar. 5, 2019.

* cited by examiner

*Primary Examiner* — Jacob M Amick
(74) *Attorney, Agent, or Firm* — Sughrue Mion, PLLC; Richard C. Turner

(57) ABSTRACT

Provided is an ignition system including: a main primary coil; a main IC configured to switch a main primary coil mode between an energization mode and a de-energization mode; a sub primary coil; a sub IC configured to switch a sub primary coil mode between an energization mode and a de-energization mode; a secondary coil; a detection unit configured to detect a state of the main primary coil; and a control unit configured to determine whether a state of a sub primary current path is normal or abnormal based on the state of the main primary coil detected by the detection unit, the sub primary current path being a current path of a sub primary current flowing through the sub primary coil.

10 Claims, 7 Drawing Sheets

IGNITION SYSTEM

TECHNICAL FIELD

The present invention relates to an ignition system.

BACKGROUND ART

Hitherto, as an ignition system configured to ignite an air-fuel mixture in a combustion chamber of an internal combustion engine, there has been proposed an ignition system including an ignition coil formed of a main primary coil, a sub primary coil, and a secondary coil (for example, see Patent Literature 1).

The ignition system described in Patent Literature 1 is configured to interrupt current supply from a power supply to a main primary coil, and then supply a current from the power supply to a sub primary coil, to thereby supply a secondary current to a secondary coil. The secondary current is a current obtained by superimposing, in an adding manner, a current generated in the secondary coil by interrupting the current supply to the main primary coil and a current generated in the secondary coil by supplying the current to the sub primary coil on each other. Moreover, in Patent Literature 1, it is described that sub primary current detection means for detecting a sub primary current being a current flowing through the sub primary coil is provided in the ignition system.

CITATION LIST

Patent Literature

[PTL 1] WO 2017/183062 A1

SUMMARY OF INVENTION

Technical Problem

In the ignition system described in Patent Literature 1, the above-mentioned sub primary current detection means is provided on a sub primary current path being a current path of the sub primary current. Thus, in order to detect an abnormality of the sub primary coil, it is only required to monitor the sub primary current detected by the sub primary current detection means. In this ignition system, in order to detect not only the abnormality of the sub primary coil, but also an abnormality of the main primary coil, it is required to monitor not only the sub primary current, but also a main primary current being a current flowing through the main primary coil. In this case, it is required to independently provide main primary current detection means for detecting the main primary current on a main primary current path being a current path of the main primary current in the ignition system.

As described above, when, in addition to the sub primary current detection means, the main primary current detection means is independently provided in the ignition system, a circuit configuration of the ignition system becomes complicated, and the number of terminals of the ignition system increases. Thus, there is required a new technology for achieving the detection of the abnormality of the sub primary coil in the ignition system without providing, on the sub primary current path, the detection means for detecting the state of the sub primary coil, specifically, the sub primary current flowing through the sub primary coil.

The present invention has been made in order to solve the above-mentioned problem, and has an object to provide an ignition system capable of determining whether a state of a sub primary current path is normal or abnormal without providing, on a sub primary current path, detection means for detecting a state of a sub primary coil.

Solution to Problem

According to the present invention, there is provided an ignition system, including: a main primary coil configured to generate an energization magnetic flux through current supply, and to generate a de-energization magnetic flux in an opposite direction to a direction of the energization magnetic flux through interruption of the current supply; a main IC configured to switch a main primary coil mode which is a mode of the main primary coil between an energization mode for supplying a current to the main primary coil and a de-energization mode for interrupting the supply of the current to the main primary coil; a sub primary coil configured to generate an additional magnetic flux in the same direction as the direction of the de-energization magnetic flux through current supply; a sub IC configured to switch a sub primary coil mode which is a mode of the sub primary coil between an energization mode for supplying a current to the sub primary coil and a de-energization mode for interrupting the supply of the current to the sub primary coil; a secondary coil configured to magnetically couple to the main primary coil and the sub primary coil, to thereby generate energy; a detection unit configured to detect a state of the main primary coil; and a control unit configured to determine whether a state of a sub primary current path being a current path of a sub primary current flowing through the sub primary coil is normal or abnormal based on the state of the main primary coil detected by the detection unit.

Advantageous Effects of Invention

According to the present invention, the ignition system capable of determining whether the state of the sub primary current path is normal or abnormal without providing, on the sub primary current path, the detection means for detecting the state of the sub primary coil can be obtained.

DESCRIPTION OF EMBODIMENTS

Now, an ignition system according to preferred embodiments of the present invention is described referring to the accompanying drawings. In the illustration of the drawings, the same or corresponding components are denoted by the same reference symbols, and overlapping description thereof is herein omitted.

First Embodiment

Figure 1:
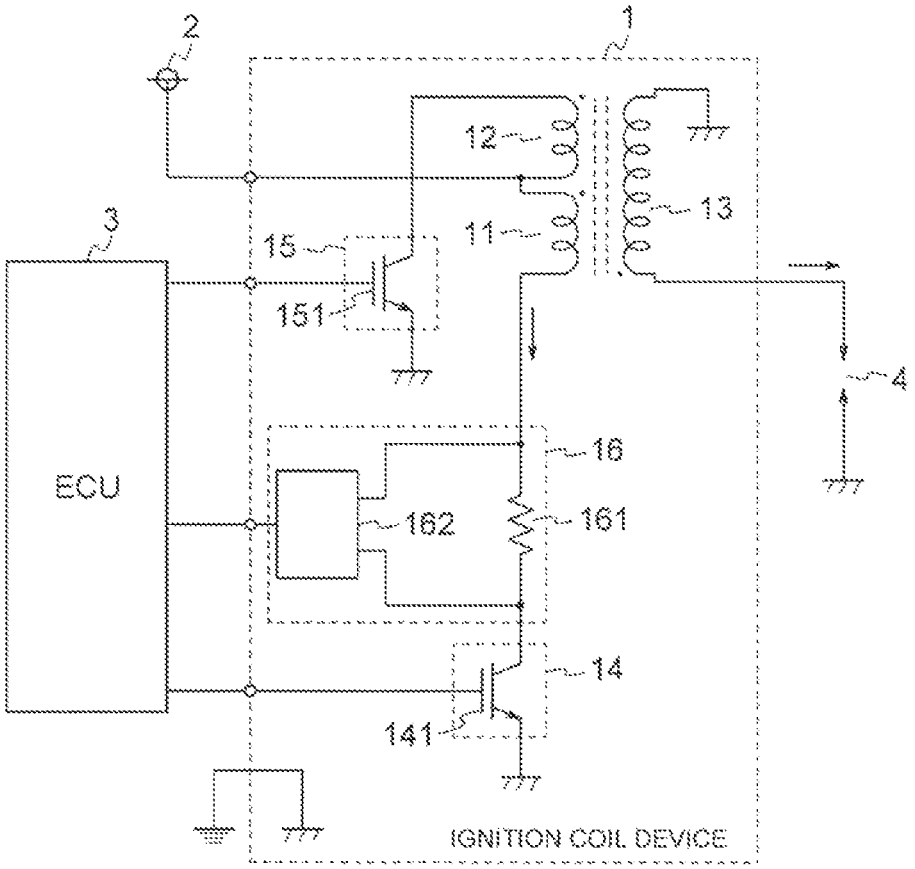
FIG. 1 is a configuration diagram for illustrating an ignition system according to a first embodiment of the present invention.

FIG. 1 is a configuration diagram for illustrating an ignition system according to a first embodiment of the present invention. The ignition system illustrated in FIG. 1 includes an ignition coil device 1, a power supply 2, an engine control unit (ECU) 3, and an ignition plug 4.

The ignition coil device 1 is mounted to an internal combustion engine, and is configured to supply energy to the ignition plug 4, to thereby generate a spark discharge in a gap of the ignition plug 4. The ignition coil device 1 includes a main primary coil 11, a sub primary coil 12, a secondary coil 13, a main integrated circuit (IC) 14, a sub integrated circuit (IC) 15, and a detection unit 16.

Each of the main primary coil 11 and the sub primary coil 12 is connected to the common power supply 2. The power supply 2 is a DC power supply, for example, a battery.

The main primary coil 11 and the sub primary coil 12 are wound so that respective magnetic fluxes generated when currents are supplied from the power supply 2 are in directions opposite to each other. That is, as seen from the power supply 2, respective polarities of the main primary coil 11 and the sub primary coil 12 are polarities opposite to each other.

When the current is supplied to the main primary coil 11 from the power supply 2, the polarity of the main primary coil 11 is an opposite polarity to the polarity of the secondary coil 13. When the current is supplied to the sub primary coil 12 from the power supply 2, the polarity of the sub primary coil 12 is the same polarity as the polarity of the secondary coil 13.

The main primary coil 11 and the sub primary coil 12 are magnetically coupled to the secondary coil 13. As a result, mutual induction occurs between the main primary coil 11 and the secondary coil 13, and between the sub primary coil 12 and the secondary coil 13.

The main primary coil 11 is configured to generate a magnetic flux through the current supply from the power supply 2. The magnetic flux generated by the main primary coil 11 through the current supply from the power supply 2 is hereinafter referred to as "energization magnetic flux." Moreover, the main primary coil 11 is configured to generate a magnetic flux in an opposite direction to a direction of the energization magnetic flux through interruption of the current supply from the power supply 2. The magnetic flux generated by the main primary coil 11 through the interruption of the current supply from the power supply 2 is hereinafter referred to as "de-energization magnetic flux."

The sub primary coil 12 is configured to generate a magnetic flux in the same direction as the direction of the energization magnetic flux through the current supply from the power supply 2. The magnetic flux generated by the sub primary coil 12 through the current supply from the power supply 2 is hereinafter referred to as "additional magnetic flux."

One end of the secondary coil 13 is connected to the ignition plug 4. The other end thereof is connected to a ground. The secondary coil 13 is magnetically coupled to the main primary coil 11 and the sub primary coil 12, to thereby generate energy. The energy generated by the secondary coil 13 is supplied to the ignition plug 4.

When the energy is supplied to the ignition plug 4, the spark discharge is generated in the gap of the ignition plug 4. As a result, the ignition plug 4 ignites a combustible air-fuel mixture in a combustion chamber of the internal combustion engine, to thereby combust the combustible air-fuel mixture.

The main IC 14 is configured to switch a mode of the main primary coil 11 between an energization mode of supplying the current from the power supply 2 to the main primary coil 11 and a de-energization mode of interrupting the current supply from the power supply 2 to the main primary coil 11. The mode of the main primary coil 11 is hereinafter referred to as "main primary coil mode."

Specifically, the main IC 14 includes a transistor 141 switchable between ON and OFF states. A collector of the transistor 141 is connected to the main primary coil 11 through intermediation of a current detection resistor 161, which is described later. An emitter of the transistor 141 is connected to the ground.

When the transistor 141 is in the ON state, the transistor 141 conducts a current between the power supply 2 and the main primary coil 11. As a result, the current supply from the power supply 2 to the main primary coil 11 can be achieved. Meanwhile, when the transistor 141 is in the OFF state, the transistor 141 interrupts the conduction between the power supply 2 and the main primary coil 11. As a result, the interruption of the current supply from the power supply 2 to the main primary coil 11 can be achieved.

The sub IC 15 is configured to switch a mode of the sub primary coil 12 between an energization mode of supplying the current from the power supply 2 to the sub primary coil 12 and a de-energization mode of interrupting the current supply from the power supply 2 to the sub primary coil 12. The mode of the sub primary coil 12 is hereinafter referred to as "sub primary coil mode."

Specifically, the sub IC 15 includes a transistor 151 switchable between ON and OFF states. A collector of the transistor 151 is connected to the sub primary coil 12. An emitter of the transistor 151 is connected to the ground.

When the transistor 151 is in the ON state, the transistor 151 conducts a current between the power supply 2 and the sub primary coil 12. As a result, the current supply from the power supply 2 to the sub primary coil 12 can be achieved. Meanwhile, when the transistor 151 is in the OFF state, the transistor 151 interrupts the conduction between the power supply 2 and the sub primary coil 12. As a result, the interruption of the current supply from the power supply 2 to the sub primary coil 12 can be achieved.

The detection unit 16 is provided on a main primary current path, and is configured to detect a state of the main primary coil 11. Specifically, the detection unit 16 is configured to detect, as the state of the main primary coil 11, a main primary current being a current flowing through the main primary coil 11. The detection unit 16 is provided between the main primary coil 11 and the main IC 14.

The detection unit 16 includes, as a specific configuration, the current detection resistor 161 and a current detection circuit 162. One end of the current detection resistor 161 is connected to the main primary coil 11. The other end thereof is connected to the main IC 14.

The current detection circuit 162 is connected to the current detection resistor 161 in parallel. The current detection circuit 162 is configured to detect a voltage generated in the current detection resistor 161, and convert the detected voltage to a current, to thereby detect the current flowing through the current detection resistor 161. The current flowing through the current detection resistor 161 is equivalent to the current flowing through the main primary coil 11. That is, the current detection circuit 162 is configured to detect the main primary current being a current flowing through the main primary coil 11. The current detection circuit 162 provides the detection result to the ECU 3.

In the first embodiment, there is exemplified a case in which the current detection resistor 161 is provided between the main primary coil 11 and the transistor 141 of the main IC 14, but the configuration is not limited to this example. That is, it is only required that the current detection resistor 161 detects the main primary current, and the current detection resistor 161 may be provided at any location such as a location between the transistor 141 and the ground.

In the first embodiment, there is exemplified the form of using the current detection resistor 161 as a specific example of the configuration for detecting the main primary current, but the configuration is not limited to this example. That is, as the configuration for detecting the main primary current, there may be provided a form in which different current detection means such as a pickup coil is used in place of the current detection resistor 161.

The ECU 3 is an example of a control unit configured to control the ignition coil device 1. The ECU 3 is configured to acquire detection results of various sensors configured to detect information on an operation state of the internal combustion engine, and determine the operation state of the internal combustion engine based on the acquired detection results of the various sensors, to thereby control the ignition coil device 1. Specifically, the ECU 3 controls drive of each of the main IC 14 and the sub IC 15 of the ignition coil device 1.

Moreover, the ECU 3 is configured to determine whether the state of a current path of a sub primary current being a current flowing through the sub primary coil 12 is normal or abnormal based on the state of the main primary coil 11 detected by the detection unit 16.

For the convenience of description, a direction of a flow of the current from the main primary coil 11 toward the current detection resistor 161, that is, a direction of the arrow of FIG. 1 is hereinafter defined as a positive direction. A direction of a flow of the current from the current detection resistor 161 toward the main primary coil 11 is defined as a negative direction.

In addition, a direction of a flow of the current from the secondary coil 13 toward the ignition plug 4, that is, a direction of the arrow of FIG. 1, is defined as a positive direction. A direction of a flow of the current from the ignition plug 4 toward the secondary coil 13 is defined as a negative direction.

Figure 2:
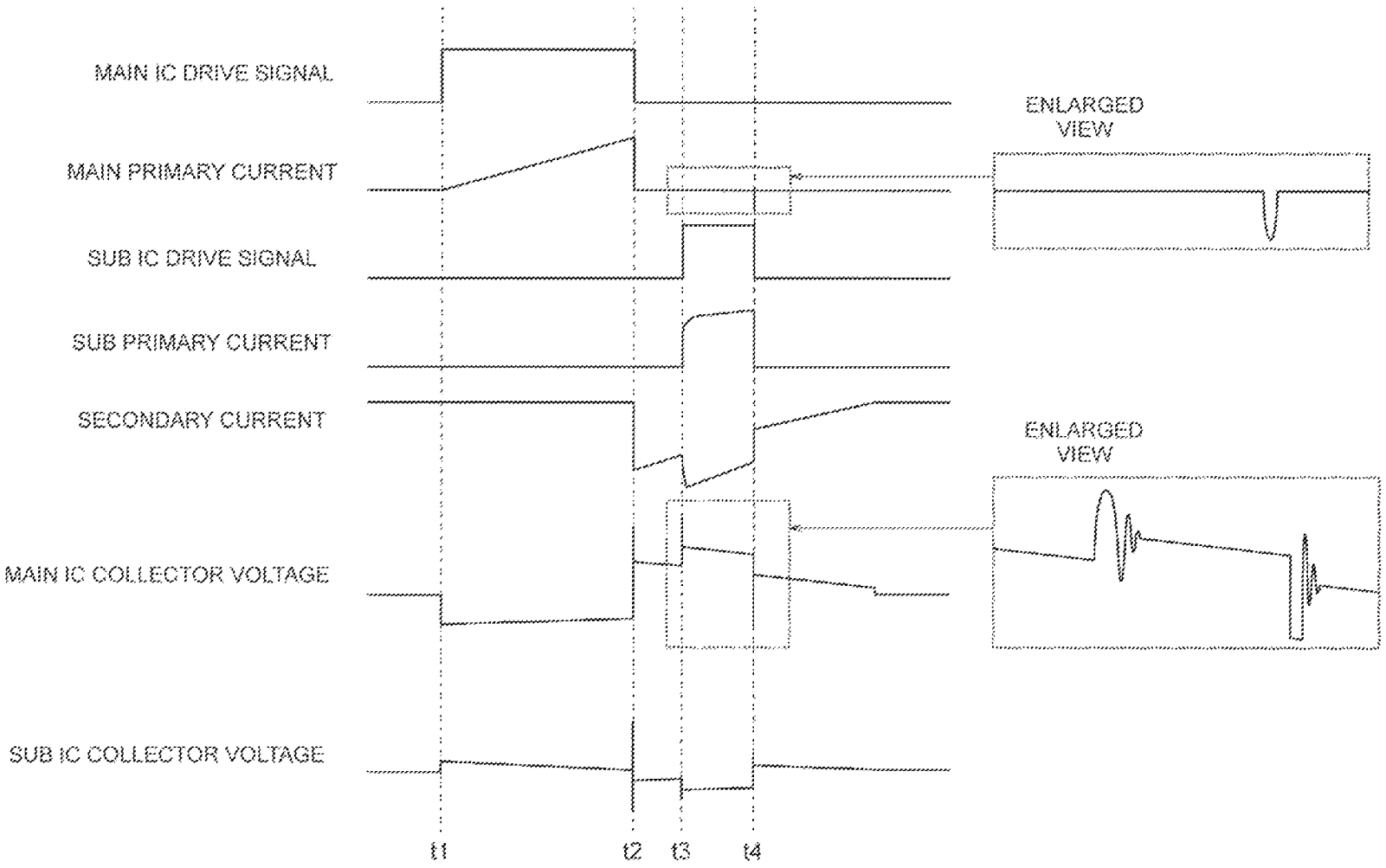
FIG. 2 is a timing chart for illustrating an operation example of the ignition system according to the first embodiment of the present invention.

Next, with reference to FIG. 2, description is given of an operation example of the ignition system in the first embodiment. FIG. 2 is a timing chart for illustrating the operation example of the ignition system according to the first embodiment of the present invention. In FIG. 2, respective temporal changes in a main IC drive signal, a main primary current, a sub IC drive signal, a sub primary current, a secondary current, a main IC collector voltage, and a sub IC collector voltage are illustrated.

Of those, the main IC drive signal is a signal for driving the main IC 14. When the main IC drive signal is input from the ECU 3 to the main IC 14, the main primary coil mode is switched from the de-energization mode to the energization mode by the drive by the main IC 14. The main primary current is a current flowing through the main primary current path formed by serially connecting mainly the main primary coil 11, the current detection resistor 161 of the detection unit 16, and the transistor 141 of the main IC 14 to each other.

The sub IC drive signal is a signal for driving the sub IC 15. When the sub IC drive signal is input from the ECU 3 to the sub IC 15, the sub primary coil mode is switched from the de-energization mode to the energization mode by the drive by the sub IC 15. The sub primary current is a current flowing through a sub primary current path formed by serially connecting mainly the sub primary coil 12 and the transistor 151 of the sub IC 15 to each other.

The secondary current is a current flowing through the secondary coil 13. The main IC collector voltage is a voltage generated between the collector and the emitter of the transistor 141 of the main IC 14. The sub IC collector voltage is a voltage generated between the collector and the emitter of the transistor 151 of the sub IC 15.

A voltage proportional to the secondary current flowing through the secondary coil 13 is generated between the collector and the emitter of each of the transistor 141 of the main IC 14 and the transistor 151 of the sub IC 15.

As illustrated in FIG. 2, when the input of the main IC drive signal from the ECU 3 to the main IC 14 is started at a time t1, the drive of the main IC 14 is started. In this case, the main primary coil mode is switched to the energization mode, and the main primary current in the positive direction thus flows through the main primary coil 11.

As described above, at the time t1, the ECU 3 drives the main IC 14, to thereby switch the main primary coil mode from the de-energization mode to the energization mode.

At a time t2, when the input of the main IC drive signal from the ECU 3 to the main IC 14 is stopped, the drive of the main IC 14 is stopped. In this case, the main primary coil mode is switched to the de-energization mode, and the main primary current thus becomes 0.

When the main primary coil mode is switched to the de-energization mode, a voltage is generated in the secondary coil 13 by the mutual induction effect. A dielectric breakdown occurs in the gap of the ignition plug 4 due to the generated voltage, to thereby generate a discharge, and the secondary current in the negative direction thus flows through the secondary coil 13.

As described above, at the time t2, the ECU 3 stops the drive of the main IC 14, to thereby switch the main primary coil mode from the energization mode to the de-energization mode.

At a time t3, when the input of the sub IC drive signal from the ECU 3 to the sub IC 15 is started, the drive of the sub IC 15 is started. In this case, the sub primary coil mode is switched to the energization mode, and the sub primary current flows through the sub primary coil 12. As illustrated in FIG. 2, the sub primary current quickly rises, and slowly increases after the rise.

As a result of the flow of the sub primary current through the sub primary coil 12, a superimposition current is generated in the secondary coil 13. The superimposition current is generated in the secondary coil 13 in accordance with a turn ratio between the sub primary coil 12 and the secondary coil 13. As illustrated in FIG. 2, the superimposition current induced by the sub primary coil 12 is superimposed on the secondary current induced by the main primary coil 11.

As described above, at the time t3, the ECU 3 drives the sub IC 15, to thereby switch the sub primary coil mode from the de-energization mode to the energization mode.

At a time t4, when the input of the sub IC drive signal from the ECU 3 to the sub IC 15 is stopped, the drive of the sub IC 15 is stopped. In this case, the sub primary coil mode is switched to the de-energization mode, and the sub primary current thus becomes 0. In this case, the superimposition current induced by the sub primary coil 12 also becomes0.

As described above, at the time t4, the ECU 3 stops the drive of the sub IC 15, to thereby switch the sub primary coil mode from the energization mode to the de-energization mode.

When the sub primary coil mode is switched from the energization mode to the de-energization mode, the main primary current in the negative direction flows through the main primary coil 11 as illustrated in FIG. 2.

That is, as illustrated in FIG. 2, when the main primary coil mode is switched to the energization mode at the time t1, the main primary current in the positive direction flows through the main primary coil 11. Meanwhile, when the sub primary coil mode is switched to the de-energization mode at the time t4, the main primary current in the negative direction opposite to the positive direction flows through the main primary coil 11.

After the time t4, the drive of the main IC 14 and the drive of the sub IC 15 are stopped, and the secondary current flowing through the secondary coil 13 decreases as the time elapses and reaches 0.

In this state, when an abnormality is not occurring to the sub primary current path, that is, when the sub primary current path is normal, the sub primary current normally flows through the sub primary coil 12. In this case, when the sub primary coil mode is switched to the de-energization mode as described above, the main primary current in the negative direction flows through the main primary coil 11.

Meanwhile, when an abnormality is occurring to the sub primary current path, the sub primary current does not normally flow through the sub primary coil 12. In this case, even when the sub primary coil mode is switched to the de-energization mode, the above-mentioned main primary current in the negative direction does not flow through the main primary coil 11.

Thus, the ECU 3 is configured to determine whether the state of the sub primary current path is normal or abnormal based on the main primary current detected by the detection unit when the sub primary coil mode is switched from the energization mode to the de-energization mode.

Further description is now given of the above-mentioned main primary current in the negative direction while examples of specific numerical values are given. As illustrated in FIG. 2, when the sub primary coil mode is switched to the de-energization mode at the time t4, the induced voltage generated in the sub primary coil 12 is, for example, 20 V. For example, when a turn ratio between the sub primary coil 12 and the main primary coil 11 is set to 4, the induced voltage generated in the main primary coil 11 is 80 V.

It is assumed that the power supply voltage of the power supply 2 is 14 V, and the resistance of the main primary current path is 10Ω. Moreover, it is assumed that, when the reverse withstand voltage of the transistor 141 of the main IC 14 is 30 V, and the sub primary coil mode is switched to the de-energization mode, a voltage corresponding to the reverse withstand voltage, that is, a voltage of 30 V is generated between the collector and the emitter of the transistor 141. Further, it is assumed that, when the sub primary coil mode is switched to the de-energization mode, a voltage of 16 V is generated as a kickback voltage in the main primary coil 11.

In the above-mentioned case, the magnitude of the main primary current in the negative direction flowing through the main primary current path is 2 A as given by the following expression.

$$(80\ \text{V}-14\ \text{V}-30\ \text{V}-16\ \text{V})/10\Omega=2\ \text{A}$$

The main primary current described above is provided from the detection unit 16 to the ECU 3, thereby enabling the ECU 3 to detect the main primary current in the negative direction flowing through the main primary current path. The ECU 3 is configured to determine whether the state of the sub primary current path is normal or abnormal based on the main primary current described above.

Figure 3:
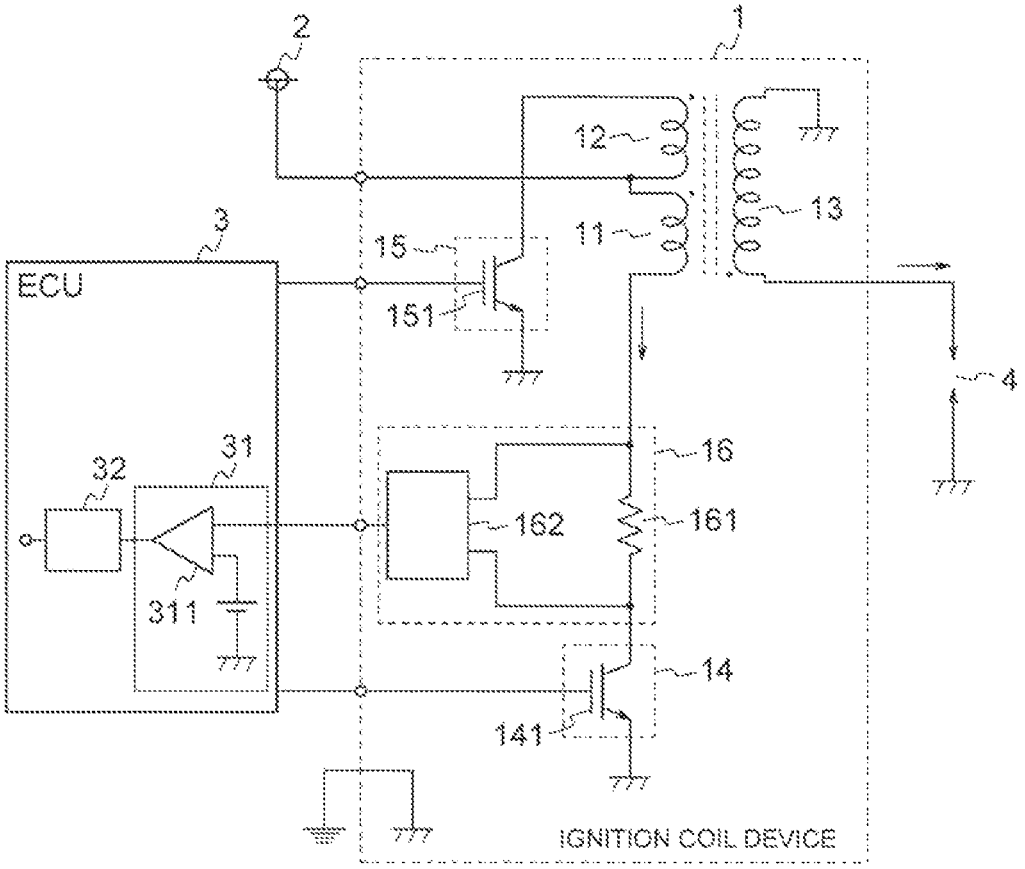
FIG. 3 is a configuration diagram for illustrating an ECU in the first embodiment of the present invention.
Figure 4:
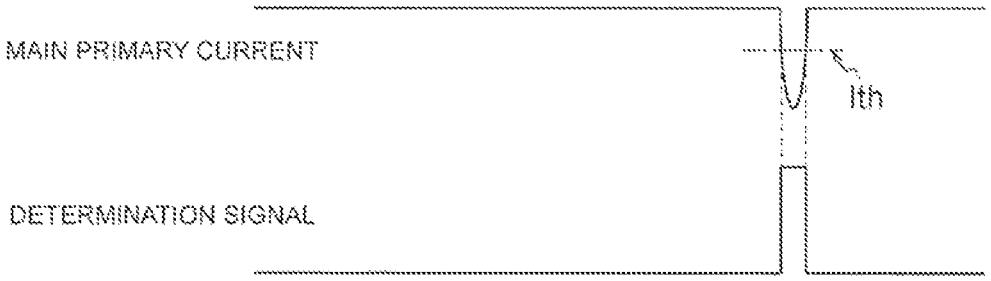
FIG. 4 is a waveform diagram for illustrating a determination signal output from a threshold circuit in the first embodiment of the present invention.

With reference to FIG. 3 and FIG. 4, description is now given of a configuration example of the ECU 3. FIG. 3 is a configuration diagram for illustrating the ECU 3 in the first embodiment of the present invention. FIG. 4 is a waveform diagram for illustrating a determination signal output from a threshold circuit 31 in the first embodiment of the present invention.

The ECU 3 of FIG. 3 includes the threshold circuit 31 and a determination circuit 32. The threshold circuit 31 is configured to compare the main primary current detected by the detection unit 16 and a current threshold value Ith set in advance with each other. The threshold circuit 31 includes, for example, a comparator 311.

The threshold circuit 31 and the determination circuit 32 may be provided inside the ECU 3, or may be provided outside the ECU 3, for example, inside the ignition coil device 1.

The current threshold value Ith is appropriately set in accordance with the value of the main primary current in the negative direction flowing through the main primary current path when the state of the sub primary current path is normal.

As illustrated in FIG. 4, the threshold circuit 31 outputs a determination signal to the determination circuit 32 when the main primary current detected by the detection unit 16 is equal to or smaller than the current threshold value Ith as a result of the comparison. Meanwhile, the threshold circuit 31 does not output the determination signal to the determination circuit 32 when the main primary current is larger than the current threshold value Ith as a result of the comparison.

When the determination signal is provided from the threshold circuit 31 under the state in which the sub primary coil mode is switched to the de-energization mode, the determination circuit 32 determines that the state of the sub primary current path is normal. Meanwhile, when the determination signal is not provided from the threshold circuit 31 under the state in which the sub primary coil mode is switched to the de-energization mode, the determination circuit 32 determines that the state of the sub primary current path is abnormal.

As described above, the ECU 3 is configured to compare the main primary current detected by the detection unit when the sub primary coil mode is switched from the energization mode to the de-energization mode and the current threshold value Ith set in advance with each other, and to then determine whether the state of the sub primary current path is normal or abnormal based on the comparison result.

When an abnormality is not occurring to the main primary current path, that is, the main primary current path is normal, the main primary current in the positive direction of FIG. 2 flows through the main primary coil 11 in a period in which the main primary coil mode is the energization mode. This period is a period from the time t1 to the time t2 of FIG. 2.

Meanwhile, when an abnormality is occurring to the main primary current path, the main primary current in the positive direction of FIG. 2 does not normally flow through the main primary coil 11 in the above-mentioned period.

Thus, the ECU 3 may be configured to determine whether the state of the main primary current path is normal or abnormal based on the main primary current detected by the detection unit 16 in the above-mentioned period. As a result, the state of the main primary current path as well as the state of the sub primary current path can be determined by the detection unit 16 provided in the main primary current path.

According to the first embodiment, the ignition system includes the control unit configured to determine whether the state of the sub primary current path is normal or abnormal based on the state of the main primary coil 11 detected by the detection unit 16 provided on the main primary current path, the sub primary current path being the current path of the sub primary current flowing through the sub primary coil 12. In the first embodiment, there is exemplified the case in which the detection unit 16 is configured to detect the main primary current flowing through the main primary coil 11 as the state of the main primary coil 11.

As a result, it is possible to determine whether the state of the sub primary current path is normal or abnormal without providing, on the sub primary current path, detection means for detecting the state of the sub primary coil 12, specifically, the sub primary current flowing through the sub primary coil 12. Moreover, it is not required to provide detection means for detecting the state of the main primary coil and detection means for detecting the state of the sub primary coil independently of each other. Consequently, it is possible to suppress an increase in the number of terminals connected from the ignition coil device 1 to the outside, and to simplify the circuit configuration of the ignition coil device 1.

Second Embodiment

In a second embodiment of the present invention, description is given of an ignition system including the ignition coil device 1 having a different configuration of the detection unit 16 from that in the first embodiment. In the second embodiment, the description of the same points as those of the first embodiment is omitted, and points different from those of the first embodiment are mainly described.

Figure 5:
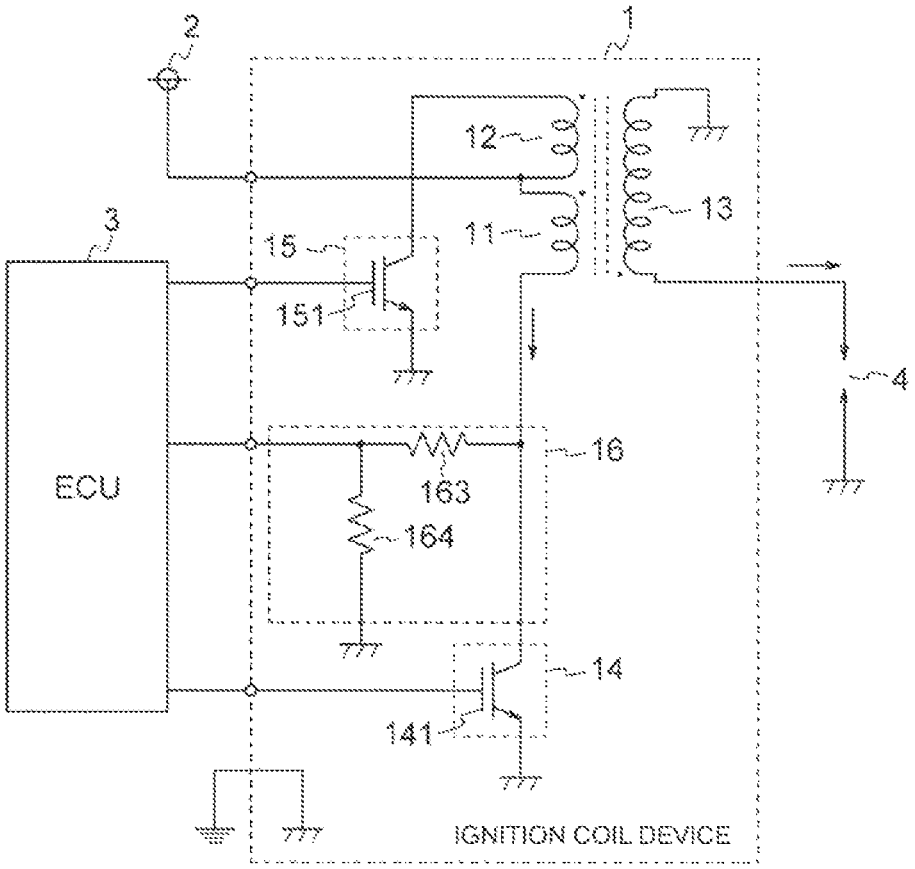
FIG. 5 is a configuration diagram for illustrating an ignition system according to a second embodiment of the present invention.

FIG. 5 is a configuration diagram for illustrating the ignition system according to the second embodiment of the present invention. The ignition system illustrated in FIG. 5 includes the ignition coil device 1, the power supply 2, the ECU 3, and the ignition plug 4.

The detection unit 16 is configured to detect, as the state of the main primary coil, a main primary voltage being the voltage generated in the main primary coil 11, which is different from the first embodiment. In the second embodiment, there is exemplified a case in which the detection unit 16 is configured to detect a voltage generated between the collector and the emitter of the transistor 141, and the voltage can be considered to be equivalent to the main primary voltage generated in the main primary coil 11. The voltage generated between the collector and the emitter of the transistor 141 corresponds to the main IC collector voltage of FIG. 2.

The detection unit 16 includes, as a specific configuration, a voltage detection resistor 163 and a voltage detection resistor 164. The detection unit 16 provides, to the ECU 3, a divided voltage obtained by using the voltage detection resistor 163 and the voltage detection resistor 164 to divide the voltage generated between the collector and the emitter of the transistor 141.

Further description is now given of the above-mentioned divided voltage while examples of specific numerical values are given. As illustrated in FIG. 2, when the sub primary coil mode is switched to the energization mode at the time t3, the induced voltage generated in the sub primary coil 12 is, for example, 10 V. For example, when the turn ratio between the sub primary coil 12 and the main primary coil 11 is set to 4, the induced voltage generated in the main primary coil 11 is 40 V.

It is assumed that the resistance value of the voltage detection resistor 163 is 360 kΩ, and the resistance value of the voltage detection resistor 164 is 40 kΩ.

In the above-mentioned case, the magnitude of the divided voltage generated in the voltage detection resistor 164 is 4 V as given by the following expression.

$$40\ \text{V} \times 40\ \text{k}\Omega/(360\ \text{k}\Omega + 40\ \text{k}\Omega) = 4\ \text{V}$$

The divided voltage described above, that is, the main primary voltage is provided from the detection unit 16 to the ECU 3, thereby enabling the ECU 3 to detect the main primary voltage generated in the main primary coil 11. The ECU 3 is configured to determine whether the state of the sub primary current path is normal or abnormal based on the main primary voltage generated when the sub primary coil mode is switched from the de-energization mode to the energization mode.

As illustrated in FIG. 2, even when the sub primary coil mode is switched to the de-energization mode at the time t4, the induced voltage is similarly generated in the main primary coil 11. Thus, the ECU 3 is configured to determine whether the state of the sub primary current path is normal or abnormal based on the main primary voltage generated in the main primary coil 11 when the sub primary coil mode is switched from the energization mode to the de-energization mode.

In the second embodiment, there is exemplified the case in which the detection unit 16 is configured to use the voltage detection resistor 163 and the voltage detection resistor 164 to divide the main IC collector voltage, but the detection unit 16 may be configured, for example, as described below. That is, the detection unit 16 may be configured to directly output the main IC collector voltage to the ECU 3 without intermediation of the resistors. Moreover, the detection unit 16 may be configured to output the main IC collector voltage to the ECU 3 through one resistor.

In the second embodiment, there is exemplified the case in which the detection unit 16 is configured to detect the voltage level of the main primary voltage generated in the main primary coil 11, but the detection unit 16 may be configured, for example, as described below. That is, the detection unit 16 may be configured to detect not the voltage level of the main primary voltage, but the frequency of the main primary voltage.

Figure 6:
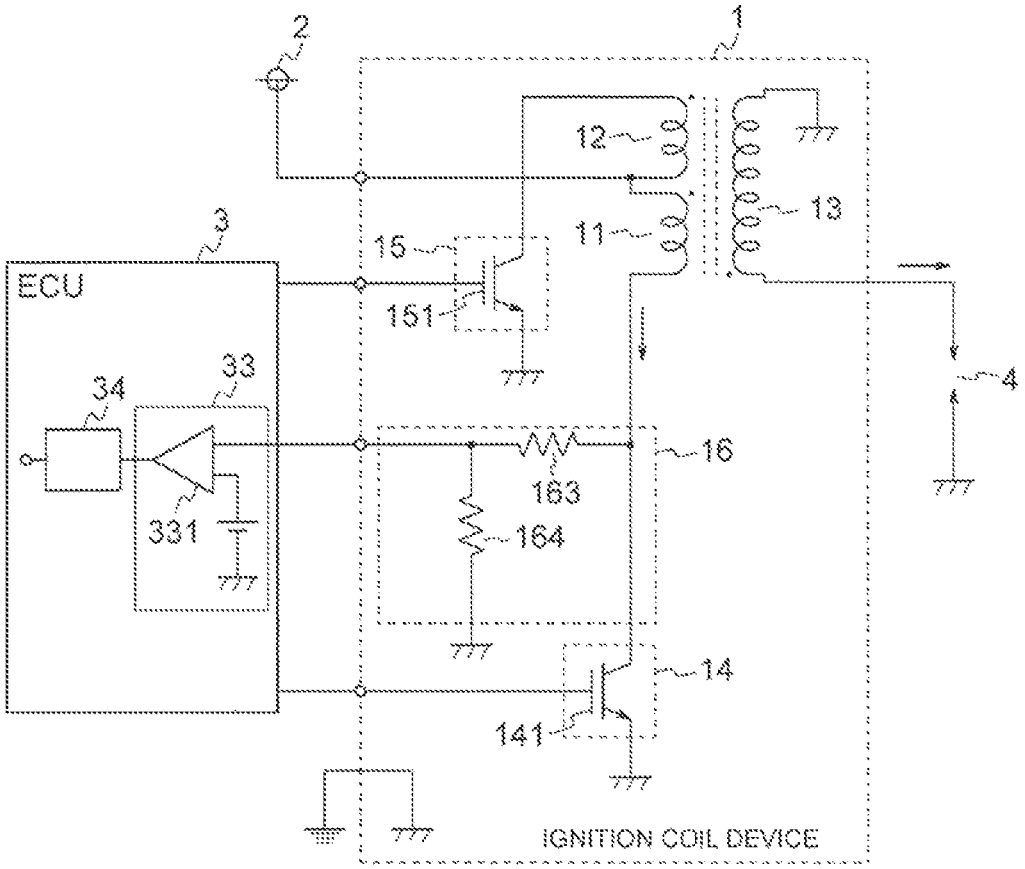
FIG. 6 is a configuration diagram for illustrating an ECU in the second embodiment of the present invention.

Next, with reference to FIG. 6, description is now given of a configuration example of the ECU 3 in the second embodiment. FIG. 6 is a configuration diagram for illustrating the ECU 3 in the second embodiment of the present invention. The ECU 3 of FIG. 6 includes a threshold circuit 33 and a determination circuit 34. The threshold circuit 33 includes, for example, a comparator 331. The threshold circuit 33 and the determination circuit 34 may be provided inside the ECU 3, or may be provided outside the ECU 3, for example, inside the ignition coil device 1.

Figure 7:
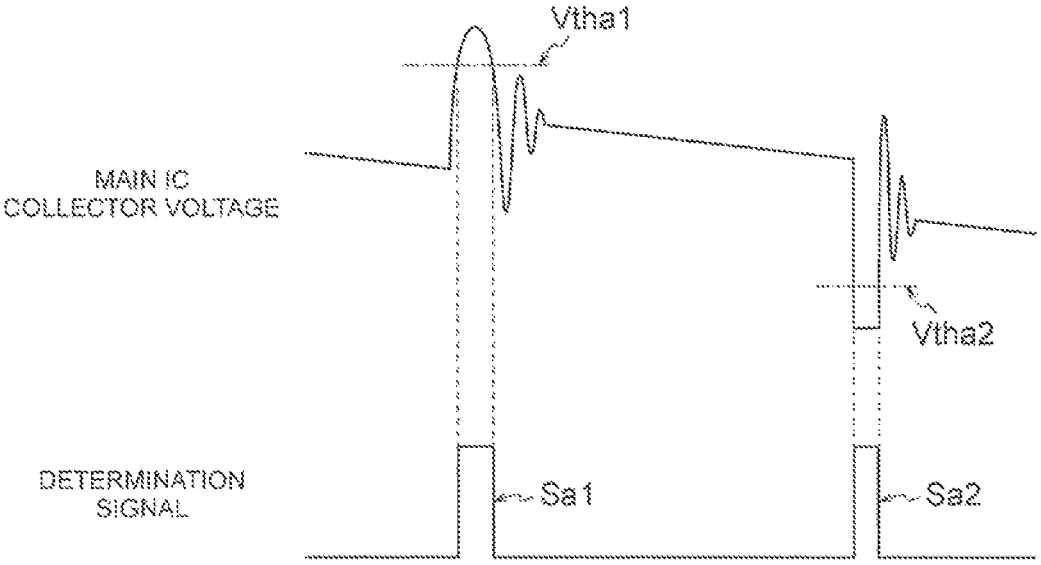
FIG. 7 is a waveform diagram for illustrating a first example and a second example of a determination signal output from a threshold circuit in the second embodiment of the present invention.

With reference to FIG. 7, description is given of a first configuration example and a second configuration example of the threshold circuit 33 and the determination circuit 34. FIG. 7 is a waveform diagram for illustrating a first example and a second example of the determination signal output from the threshold circuit 33 in the second embodiment of the present invention.

First, description is given of the first configuration example of the threshold circuit 33 and the determination circuit 34. The threshold circuit 33 is configured to compare the main IC collector voltage detected by the detection unit 16 when the sub primary coil mode is switched to the energization mode and a voltage threshold value Vtha1 set in advance with each other.

In this configuration, the voltage threshold value Vtha1 is appropriately set in accordance with the value of the voltage generated between the collector and the emitter of the transistor 141 of the main IC 14 when the sub primary coil mode is switched to the energization mode in the case in which the state of the sub primary current path is normal.

As illustrated in FIG. 7, the threshold circuit 33 outputs a determination signal Sa1 to the determination circuit 34 when the main IC collector voltage detected by the detection unit 16 is equal to or larger than the voltage threshold value Vtha1 as a result of the comparison. Meanwhile, the threshold circuit 33 does not output the determination signal Sa1 to the determination circuit 34 when the main IC collector voltage detected by the detection unit 16 is smaller than the voltage threshold value Vtha1 as a result of the comparison.

When the determination signal Sa1 is provided from the threshold circuit 33 under the state in which the sub primary coil mode is switched to the energization mode, the determination circuit 34 determines that the state of the sub primary current path is normal. Meanwhile, when the determination signal Sa1 is not provided from the threshold circuit 33 under the state in which the sub primary coil mode is switched to the energization mode, the determination circuit 34 determines that the state of the sub primary current path is abnormal.

As described above, the ECU 3 is configured to compare the main primary voltage detected by the detection unit 16 when the sub primary coil mode is switched from the de-energization mode to the energization mode and the voltage threshold value set in advance with each other. The ECU 3 is configured to further determine whether the state of the sub primary current path is normal or abnormal based on the comparison result.

Subsequently, description is given of the second configuration example of the threshold circuit 33 and the determination circuit 34. The threshold circuit 33 is configured to compare the main IC collector voltage detected by the detection unit 16 when the sub primary coil mode is switched to the de-energization mode and a voltage threshold value Vtha2 set in advance with each other.

In this configuration, the voltage threshold value Vtha2 is appropriately set in accordance with the voltage generated between the collector and the emitter of the transistor 141 of the main IC 14 when the sub primary coil mode is switched to the de-energization mode in the case in which the state of the sub primary current path is normal.

As illustrated in FIG. 7, the threshold circuit 33 outputs a determination signal Sa2 to the determination circuit 34 when the main IC collector voltage detected by the detection unit 16 is equal to or smaller than the voltage threshold value Vtha2 as a result of the comparison. Meanwhile, the threshold circuit 33 does not output the determination signal Sa2 to the determination circuit 34 when the main IC collector voltage detected by the detection unit 16 is larger than the voltage threshold value Vtha2 as a result of the comparison.

When the determination signal Sa2 is provided from the threshold circuit 33 under the state in which the sub primary coil mode is switched to the de-energization mode, the determination circuit 34 determines that the state of the sub primary current path is normal. Meanwhile, when the determination signal Sa2 is not provided from the threshold circuit 33 under the state in which the sub primary coil mode is switched to the de-energization mode, the determination circuit 34 determines that the state of the sub primary current path is abnormal.

As described above, the ECU 3 is configured to compare the main primary voltage detected by the detection unit when the sub primary coil mode is switched from the energization mode to the de-energization mode and the voltage threshold value set in advance with each other. The ECU 3 is configured to further determine whether the state of the sub primary current path is normal or abnormal based on the comparison result.

The ECU 3 may be configured to combine the first configuration example and the second configuration example with each other, to thereby determine the state of the sub primary current path. In this case, the determination circuit 34 determines that the state of the sub primary current path is normal when both of the determination signal Sa1 and the determination signal Sa2 are provided. Meanwhile, the determination circuit 34 determines that the state of the sub primary current path is abnormal when both of the determination signal Sa1 and the determination signal Sa2 are not provided.

Figure 8:
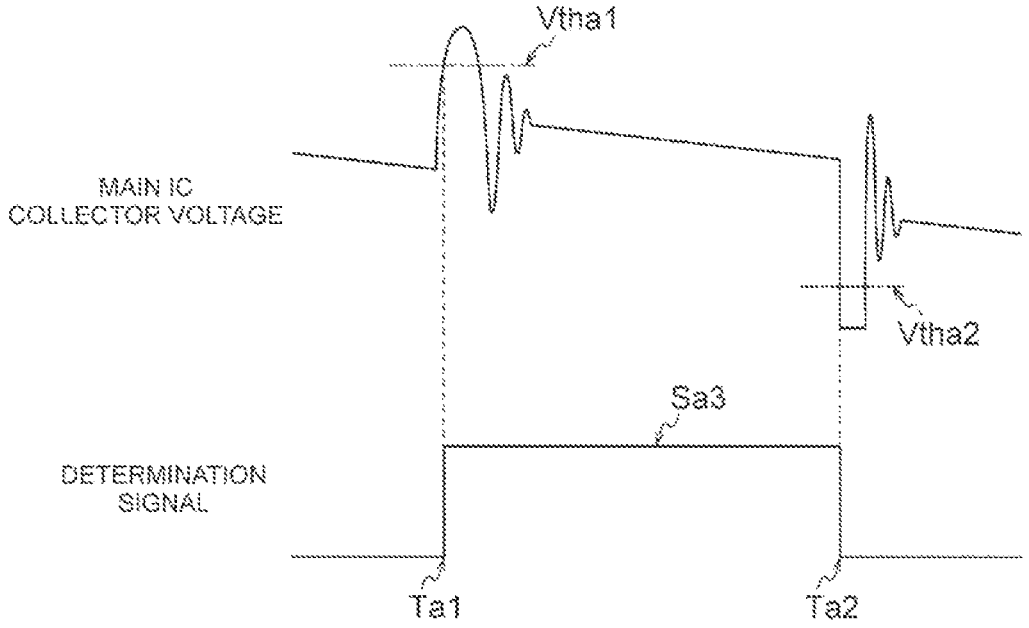
FIG. 8 is a waveform diagram for illustrating a third example of the determination signal output from the threshold circuit in the second embodiment of the present invention.

Next, with reference to FIG. 8, description is given of a third configuration example of the threshold circuit 33 and the determination circuit 34. FIG. 8 is a waveform diagram for illustrating a third example of the determination signal output from the threshold circuit 33 in the second embodiment of the present invention. Description is given of the third configuration example of the threshold circuit 33 and the determination circuit 34.

The threshold circuit 33 starts output of a determination signal Sa3 at a timing Ta1 at which the main IC collector voltage detected by the detection unit 16 when the sub primary coil mode is switched to the energization mode reaches the voltage threshold value Vtha1. Moreover, the threshold circuit 33 stops the output of the determination signal Sa3 at a timing Ta2 at which the main IC collector voltage detected by the detection unit 16 when the sub primary coil mode is switched to the de-energization mode reaches the voltage threshold value Vtha2.

The determination circuit 34 detects a period in which the output of the determination signal Sa3 from the threshold circuit 33 continues, that is, a period between the timing Ta1 and the timing Ta2, to thereby determine the state of the sub primary current path. Specifically, the determination circuit 34 determines that the state of the sub primary current path is normal when the period can be detected, and determines that the state of the sub primary current path is abnormal when the period cannot be detected.

As described above, the ECU 3 is configured to detect the period between the timing Ta1 and the timing Ta2, to thereby determine whether the state of the sub primary current path is normal or abnormal.

Figure 9:
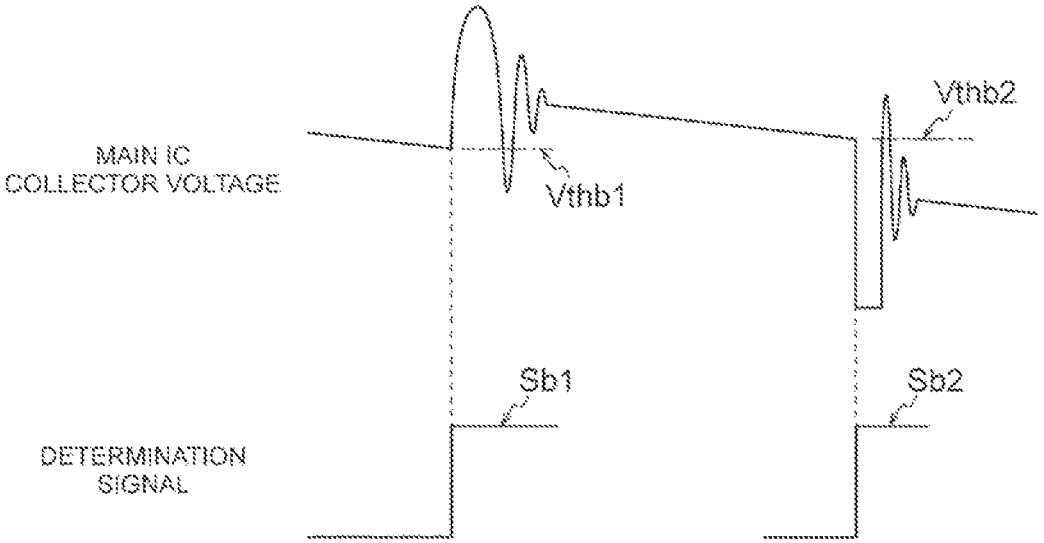
FIG. 9 is a waveform diagram for illustrating a fourth example and a fifth example of the determination signal output from the threshold circuit in the second embodiment of the present invention.

Next, with reference to FIG. 9, description is given of a fourth configuration example and a fifth configuration example of the threshold circuit 33 and the determination circuit 34. FIG. 9 is a waveform diagram for illustrating a fourth example and a fifth example of the determination signal output from the threshold circuit 33 in the second embodiment of the present invention.

First, description is given of the fourth configuration example of the threshold circuit 33 and the determination circuit 34. The threshold circuit 33 is configured to compare the main IC collector voltage detected by the detection unit 16 when the sub primary coil mode is switched to the energization mode and a voltage threshold value Vthb1 set in advance with each other.

In this configuration, the voltage threshold value Vthb1 is set to be the voltage generated between the collector and the emitter of the transistor 141 of the main IC 14 immediately before the timing at which the sub primary coil mode is switched to the energization mode in the case in which the state of the sub primary current path is normal.

As illustrated in FIG. 9, the threshold circuit 33 outputs a determination signal Sb1 to the determination circuit 34 when the main IC collector voltage detected by the detection unit 16 is equal to or larger than the voltage threshold value Vthb1 as a result of the comparison. Meanwhile, the threshold circuit 33 does not output the determination signal Sb1 to the determination circuit 34 when the main IC collector voltage detected by the detection unit 16 is smaller than the voltage threshold value Vthb1 as a result of the comparison.

When the determination signal Sb1 is provided from the threshold circuit 33 under the state in which the sub primary coil mode is switched to the energization mode, the determination circuit 34 determines that the state of the sub primary current path is normal. Meanwhile, when the determination signal Sb1 is not provided from the threshold circuit 33 under the state in which the sub primary coil mode is switched to the energization mode, the determination circuit 34 determines that the state of the sub primary current path is abnormal.

As described above, the ECU 3 is configured to compare the main primary voltage detected by the detection unit 16 when the sub primary coil mode is switched from the de-energization mode to the energization mode and the voltage threshold value Vthb1 set in advance with each other. The ECU 3 is configured to further determine whether the state of the sub primary current path is normal or abnormal based on the comparison result.

Next, description is given of the fifth configuration example of the threshold circuit 33 and the determination circuit 34. The threshold circuit 33 is configured to compare the main IC collector voltage detected by the detection unit 16 when the sub primary coil mode is switched to the de-energization mode and a voltage threshold value Vthb2 set in advance with each other.

In this configuration, the voltage threshold value Vthb2 is set to be the voltage generated between the collector and the emitter of the transistor 141 of the main IC 14 immediately before the timing at which the sub primary coil mode is switched to the de-energization mode in the case in which the state of the sub primary current path is normal.

As illustrated in FIG. 9, the threshold circuit 33 outputs a determination signal Sb2 to the determination circuit 34 when the main IC collector voltage detected by the detection unit 16 is equal to or smaller than the voltage threshold value Vthb2 as a result of the comparison. Meanwhile, the threshold circuit 33 does not output the determination signal Sb2 to the determination circuit 34 when the main IC collector voltage detected by the detection unit 16 is larger than the voltage threshold value Vthb2 as a result of the comparison.

When the determination signal Sb2 is provided from the threshold circuit 33 under the state in which the sub primary coil mode is switched to the de-energization mode, the determination circuit 34 determines that the state of the sub primary current path is normal. Meanwhile, when the determination signal Sb2 is not provided from the threshold circuit 33 under the state in which the sub primary coil mode is switched to the de-energization mode, the determination circuit 34 determines that the state of the sub primary current path is abnormal.

As described above, the ECU 3 is configured to compare the main primary voltage detected by the detection unit when the sub primary coil mode is switched from the energization mode to the de-energization mode and the voltage threshold value Vthb2 set in advance with each other. The ECU 3 is configured to further determine whether the state of the sub primary current path is normal or abnormal based on the comparison result.

The ECU 3 may be configured to combine the fourth configuration example and the fifth configuration example with each other, to thereby determine the state of the sub primary current path. In this case, the determination circuit 34 determines that the state of the sub primary current path is normal when both of the determination signal Sb1 and the determination signal Sb2 are provided. Meanwhile, the determination circuit 34 determines that the state of the sub primary current path is abnormal when both of the determination signal Sb1 and the determination signal Sb2 are not provided.

Figure 10:
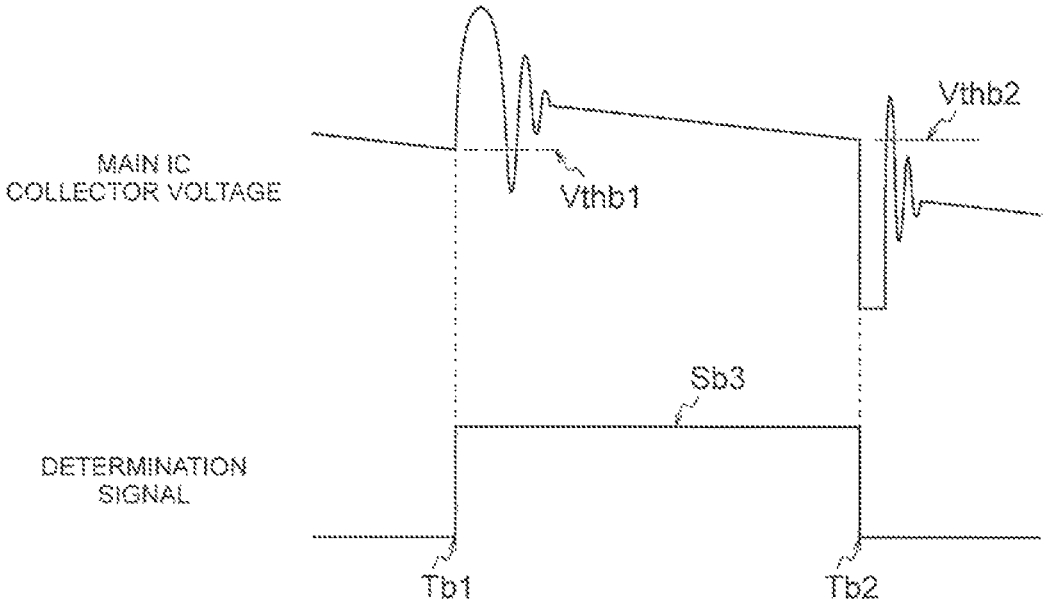
FIG. 10 is a waveform diagram for illustrating a sixth example of the determination signal output from the threshold circuit in the second embodiment of the present invention.

Next, with reference to FIG. 10, description is given of a sixth configuration example of the threshold circuit 33 and the determination circuit 34. FIG. 10 is a waveform diagram for illustrating a sixth example of the determination signal output from the threshold circuit 33 in the second embodiment of the present invention. Description is given of the sixth configuration example of the threshold circuit 33 and the determination circuit 34.

The threshold circuit 33 starts output of a determination signal Sb3 at a timing Tb1 at which the main IC collector voltage detected by the detection unit 16 when the sub primary coil mode is switched to the energization mode reaches the voltage threshold value Vthb1. Moreover, the threshold circuit 33 stops the output of the determination signal Sb3 at a timing Tb2 at which the main IC collector voltage detected by the detection unit 16 when the sub primary coil mode is switched to the de-energization mode reaches the voltage threshold value Vthb2.

The determination circuit 34 detects a period in which the output of the determination signal Sb3 from the threshold circuit 33 continues, that is, a period between the timing Tb1 and the timing Tb2, to thereby determine the state of the sub primary current path. Specifically, the determination circuit 34 determines that the state of the sub primary current path is normal when the period can be detected, and determines that the state of the sub primary current path is abnormal when the period cannot be detected.

As described above, the ECU 3 is configured to detect the period between the timing Tb1 and the timing Tb2, to thereby determine whether the state of the sub primary current path is normal or abnormal.

As described above, according to the second embodiment, the ignition system includes the control unit configured to determine whether the state of the sub primary current path is normal or abnormal based on the state of the main primary coil 11 detected by the detection unit 16 provided on the main primary current path. In the second embodiment, there is exemplified the case in which the detection unit 16 is configured to detect the main primary voltage generated in the main primary coil 11 as the state of the main primary coil 11. Even in the case of the configuration as described above, the same effects as those in the first embodiment are obtained.

In the first embodiment and the second embodiment, there is exemplified the case in which the ECU 3 is used to implement the function of the control unit configured to determine whether the state of the sub primary current path is normal or abnormal based on the state of the main primary coil 11 detected by the detection unit 16, but the configuration is not limited to this example. For example, the control unit may be independent of the ECU 3. In this case, the function of the control unit is implemented by, for example, a processing circuit independent of the ECU 3. The processing circuit configured to implement the function of the control unit may be dedicated hardware or a processor configured to execute a program stored in a memory.

REFERENCE SIGNS LIST

1 ignition coil device, 2 power supply, 3 ECU, 4 ignition plug, 11 main primary coil, 12 sub primary coil, 13 secondary coil, 14 main IC, 15 sub IC, 16 detection unit, 31 threshold circuit, 32 determination circuit, 33 threshold circuit, 34 determination circuit, 141 transistor, 151 transistor, 161 current detection resistor, 162 current detection circuit, 163 voltage detection resistor, 164 voltage detection resistor, 311 comparator, 331 comparator.

The invention claimed is:

1. An ignition system, comprising:

a main primary coil configured to generate an energization magnetic flux through current supply, and to generate a de-energization magnetic flux in an opposite direction to a direction of the energization magnetic flux through interruption of the current supply;

a main IC configured to switch a main primary coil mode which is a mode of the main primary coil between an energization mode for supplying a current to the main primary coil and a de-energization mode for interrupting the supply of the current to the main primary coil;

a sub primary coil configured to generate an additional magnetic flux in the same direction as the direction of the de-energization magnetic flux through current supply;

a sub IC configured to switch a sub primary coil mode which is a mode of the sub primary coil between an energization mode for supplying a current to the sub primary coil and a de-energization mode for interrupting the supply of the current to the sub primary coil;

a secondary coil configured to magnetically couple to the main primary coil and the sub primary coil, to thereby generate energy;

a detection unit configured to detect a state of the main primary coil; and a control unit configured to determine whether a state of a sub primary current path being a current path of a sub primary current flowing through the sub primary coil is normal or abnormal based on the state of the main primary coil detected by the detection unit.

2. The ignition system according to claim 1, wherein the detection unit is configured to detect, as the state of the main primary coil, a main primary current flowing through the main primary coil.

3. The ignition system according to claim 2, wherein the control unit is configured to determine whether the state of the sub primary current path is normal or abnormal based on the main primary current detected by the detection unit when the sub primary coil mode is switched from the energization mode to the de-energization mode.

4. The ignition system according to claim 3, wherein the control unit is configured to compare the main primary current detected by the detection unit when the sub primary coil mode is switched from the energization mode to the de-energization mode and a current threshold value set in advance with each other, and to then determine whether the state of the sub primary current path is normal or abnormal based on a comparison result.

5. The ignition system according to claim 1, wherein the detection unit is configured to detect, as the state of the main primary coil, a main primary voltage generated in the main primary coil.

6. The ignition system according to claim 5, wherein the control unit is configured to determine whether the state of the sub primary current path is normal or abnormal based on the main primary voltage detected by the detection unit when the sub primary coil mode is switched from the de-energization mode to the energization mode.

7. The ignition system according to claim 6, wherein the control unit is configured to compare the main primary voltage detected by the detection unit when the sub primary coil mode is switched from the de-energization mode to the energization mode and a voltage threshold value set in advance with each other, and to then determine whether the state of the sub primary current path is normal or abnormal based on a comparison result.

8. The ignition system according to claim 5, wherein the control unit is configured to determine whether the state of the sub primary current path is normal or abnormal based on the main primary voltage detected by the detection unit when the sub primary coil mode is switched from the energization mode to the de-energization mode.

9. The ignition system according to claim 8, wherein the control unit is configured to compare the main primary voltage detected by the detection unit when the sub primary coil mode is switched from the energization mode to the de-energization mode and a voltage threshold value set in advance with each other, and to then determine whether the state of the sub primary current path is normal or abnormal based on a comparison result.

10. The ignition system according to claim 5, wherein the control unit is configured to detect a period between a timing at which the main primary voltage detected by the detection unit when the sub primary coil mode is switched from the de-energization mode to the energization mode reaches a first voltage threshold value set in advance and a timing at which the main primary voltage detected by the detection unit when the sub primary coil mode is switched from the energization mode to the de-energization mode reaches a second voltage threshold value set in advance, to thereby determine whether the state of the sub primary current path is normal or abnormal.

* * * * *